US010655207B2

(12) United States Patent
Yang et al.

(10) Patent No.: US 10,655,207 B2
(45) Date of Patent: May 19, 2020

(54) ATMOSPHERIC-PRESSURE ACETYLENE CARBURIZING FURNACE

(71) Applicant: Shanghai Yibai Industrial Furnaces Co., Ltd., Shanghai (CN)

(72) Inventors: Jingfeng Yang, Dafeng (CN); Peng Shen, Anqing (CN); Fan Yang, Shanghai (CN)

(73) Assignee: Shanghai Yibai Industrial Furnaces Co., Ltd., Shanghai (CN)

( * ) Notice: Subject to any disclaimer, the term of this patent is extended or adjusted under 35 U.S.C. 154(b) by 166 days.

(21) Appl. No.: 15/952,599

(22) Filed: Apr. 13, 2018

(65) Prior Publication Data

US 2018/0355463 A1 Dec. 13, 2018

(30) Foreign Application Priority Data

Jun. 7, 2017 (CN) ..... 2017 1 0423172

(51) Int. Cl.

| | |
|---|---|
| ***F27B 5/04*** | (2006.01) |
| ***C23C 8/20*** | (2006.01) |
| ***F27B 5/16*** | (2006.01) |
| ***F27B 5/18*** | (2006.01) |
| ***C23C 8/22*** | (2006.01) |

(52) U.S. Cl.

CPC ..... *C23C 8/20* (2013.01); *C23C 8/22* (2013.01); *F27B 5/04* (2013.01); *F27B 5/16* (2013.01); *F27B 5/18* (2013.01)

(58) Field of Classification Search

CPC ..... F27B 5/04; F27B 5/16; F27B 5/18

See application file for complete search history.

(56) References Cited

U.S. PATENT DOCUMENTS

| | | | | |
|---|---|---|---|---|
| 5,415,025 | A * | 5/1995 | Bartman | G01N 1/2258 73/23.2 |
| 6,627,155 | B1 * | 9/2003 | Uemura | G01N 31/12 250/288 |
| 7,276,204 | B2 * | 10/2007 | Ebihara | C23C 8/20 266/250 |
| 2008/0283153 | A1 * | 11/2008 | Zurecki | H05H 1/48 148/217 |
| 2013/0008565 | A1 * | 1/2013 | Zurecki | C23C 8/30 148/215 |

* cited by examiner

*Primary Examiner* — Scott R Kastler

(74) *Attorney, Agent, or Firm* — Muncy, Geissler, Olds & Lowe, P.C.

(57) ABSTRACT

The Invention relates to an atmospheric-pressure acetylene carburizing furnace, comprises a reaction chamber, an acetylene intake duct, an exhaust gas duct, a control and metering apparatus, an exhaust gas measurement apparatus, and a computer controller. The computer controller calculates a total amount of carbon in the furnace and an enrichment rate of a workpiece, and adjusts an acetylene intake volume according to the calculation result until process requirements are met. The Invention realizes carburizing with acetylene under atmospheric pressure and reduces the usage costs while improving the equipment efficiency.

7 Claims, 2 Drawing Sheets

ATMOSPHERIC-PRESSURE ACETYLENE CARBURIZING FURNACE

FIELD OF THE INVENTION

The Invention relates to a carburizing furnace, and more particularly to an atmospheric-pressure acetylene carburizing furnace.

BACKGROUND OF THE INVENTION

There are mainly two types of commercially available carburizing furnaces: ordinary carburizing furnaces and vacuum carburizing furnaces.

Ordinary carburizing furnaces use dimethylmethane (or acetone) as the carburizing atmosphere. Dimethylmethane (or acetone) decomposes at a high temperature to produce carbon atoms. Carbon atoms are free and cannot effectively reach the product surface, resulting in low carburizing speed and efficiency. To improve the carburizing speed and efficiency, some carrier gases (or enriched gases) such as methanol are usually added. The carrier gas (or enriched gas) carries the free carbon atoms in the furnace to the product surface, increasing the probability of contact between the product surface and carbon atoms, thereby improving the production efficiency.

Vacuum furnaces require high manufacturing costs and are unaffordable for many users. Vacuum carburizing furnaces have advantages of in high product quality and performance that ordinary carburizing furnaces cannot achieve, and are disadvantageous in high purchase costs, the need of professional heat treatment personnel and professional operators in use, and higher power consumption than ordinary carburizing furnaces.

The use of acetylene as the carburizing atmosphere is not applicable to ordinary carburizing furnaces because the carbon potential or decomposing furnace in the furnace cannot be actually measured. As acetylene does not compose at a high temperature, carbon atoms can be obtained through decomposition only by using a metal as the catalyst. Commercially available oxygen probes and carbon monoxide analyzers calculates the carbon potential with reference to the oxygen element in the furnace. The use of acetylene as the carburizing atmosphere is applicable to vacuum carburizing furnaces, because vacuum carburizing furnaces are controlled in a different manner Vacuum carburizing furnaces calculate the carbon-rich ability of the product surface by using a complex surface area calculation method, and control the acetylene intake volume by using pulses, so as to meet product carburizing requirements.

SUMMARY OF THE INVENTION

An objective of the Invention is to overcome the defects in the prior art and provide an atmospheric-pressure acetylene carburizing furnace capable of accurately controlling the enrichment rate in the furnace.

The objective of the Invention can be realized through the following technical solutions:

An atmospheric-pressure acetylene carburizing furnace, comprising a reaction chamber, an acetylene intake duct, and an exhaust gas duct, wherein the acetylene carburizing furnace further comprises a control and metering apparatus arranged on the acetylene intake duct, an exhaust gas measurement apparatus arranged on the exhaust gas duct, and a computer controller respectively connected to the control and metering apparatus and the exhaust gas measurement apparatus, after a set temperature is reached in the reaction chamber, the computer controller turns on the control and metering apparatus according to a set parameter to introduce acetylene into the reaction chamber, the control and metering apparatus and the exhaust gas measurement apparatus respectively sends acetylene data and exhaust gas measurement data to the computer controller in real time, and the computer controller calculates a total amount of carbon in the furnace and an enrichment rate of a workpiece, and adjusts an acetylene intake volume according to the calculation result until process requirements are met.

The exhaust gas measurement apparatus comprises a mass spectrometer.

The computer controller calculates the total amount of carbon in the furnace according to the received data and the law of conservation of mass.

A method for calculating the total amount of carbon comprises: the control and metering apparatus sending a total amount of acetylene entering the reaction chamber to the computer controller; the exhaust gas measurement apparatus measuring a percentage by volume of each gas in an exhaust gas, calculating mass of each gas, and sending the percentage by volume and the mass to the computer controller; and the computer controller calculating the total amount of carbon in the furnace according to thermal decomposition reaction of acetylene and the law of conservation of mass.

An stirring apparatus is arranged at the top of the reaction chamber.

A heating apparatus is arranged in the reaction chamber.

A thermal insulation layer is wrapped around an outer layer of the reaction chamber.

In comparison with the prior art, the Invention has the following advantages:

(1) In comparison with other gases, acetylene features a high carbon yield, can achieve a higher carburizing speed when being used for manufacturing a same product using a same process, requires a smaller amount of gas source. Carburizing with acetylene can be implemented under atmospheric pressure, so that the equipment efficiency can be improved while reducing the usage costs.

(2) The enrichment rate in the furnace can be measured in real time, and can be accurately controlled. A same control method can be adopted for various workpieces without being limited by the shape and the surface area of the target workpiece.

(3) An ordinary box-type heat treatment furnace is used, achieving high practicability, low manufacturing costs, and low usage costs. Continuous production is allowed because vacuuming is not needed before reaction.

(4) The mass spectrometer can simultaneously measure the percentage in volume of each gas in a gas mixture, and can also calculate mass of each gas in the exhaust gas according to the volume of gas flowing therethrough, thereby implementing real-time measurement and calculation.

LIST OF REFERENCE NUMERALS

Figure 1:
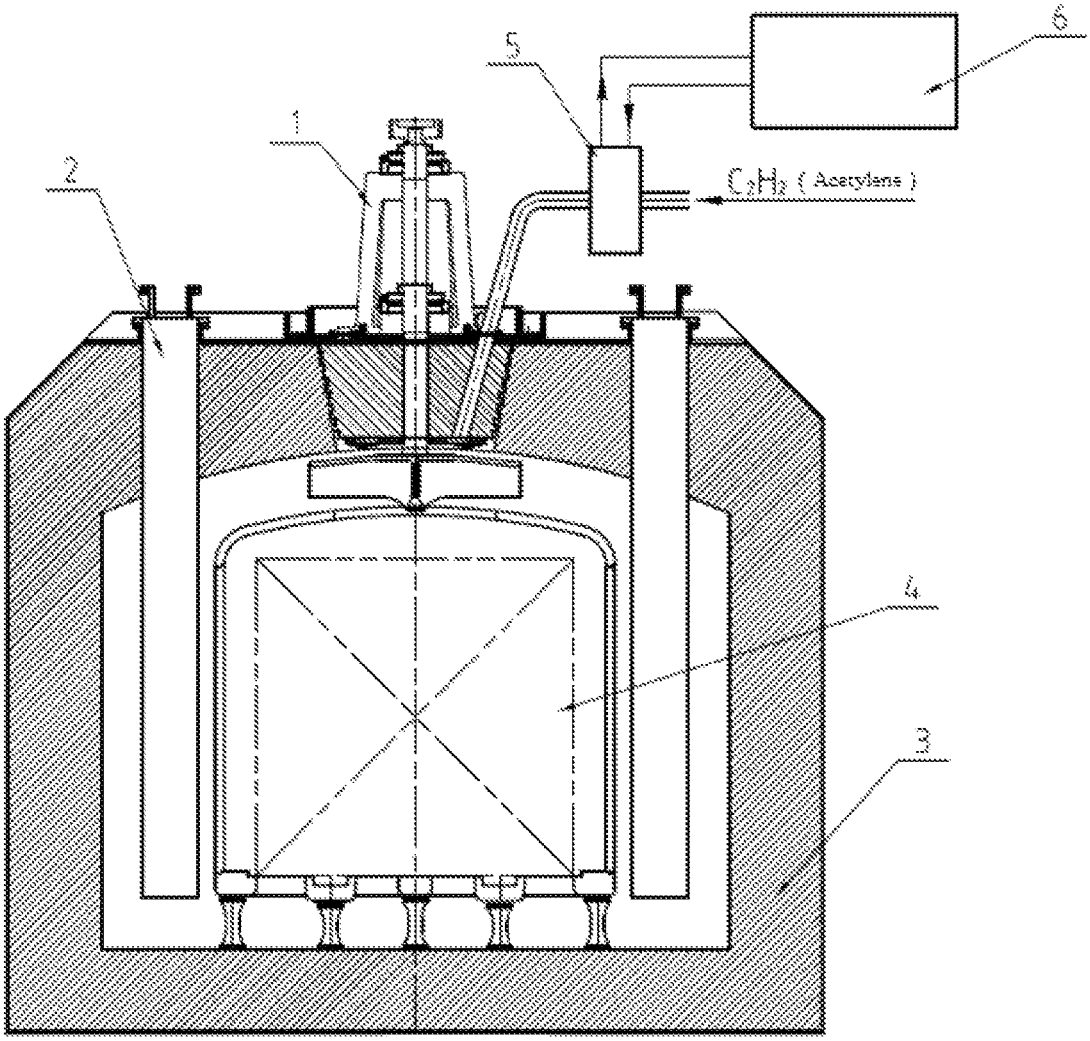
FIG. 1 is a schematic structural cross-sectional front view of an acetylene carburizing furnace according to the Invention.

In the Figures: stirring apparatus 1; heating apparatus 2; thermal insulation layer 3; workpiece 4; control and metering apparatus 5; computer controller 6; exhaust gas measurement apparatus 7; reaction chamber 8; furnace door 9.

DETAILED DESCRIPTION OF THE INVENTION

The Invention is described in detail below in conjunction with the accompanying drawings and a specific embodiment. This embodiment is implemented on the basis of the technical solution of the Invention and provides a detailed implementation and specific operation process, but the protection scope of the Invention is not limited to the following embodiment.

Embodiment

Figure 2:
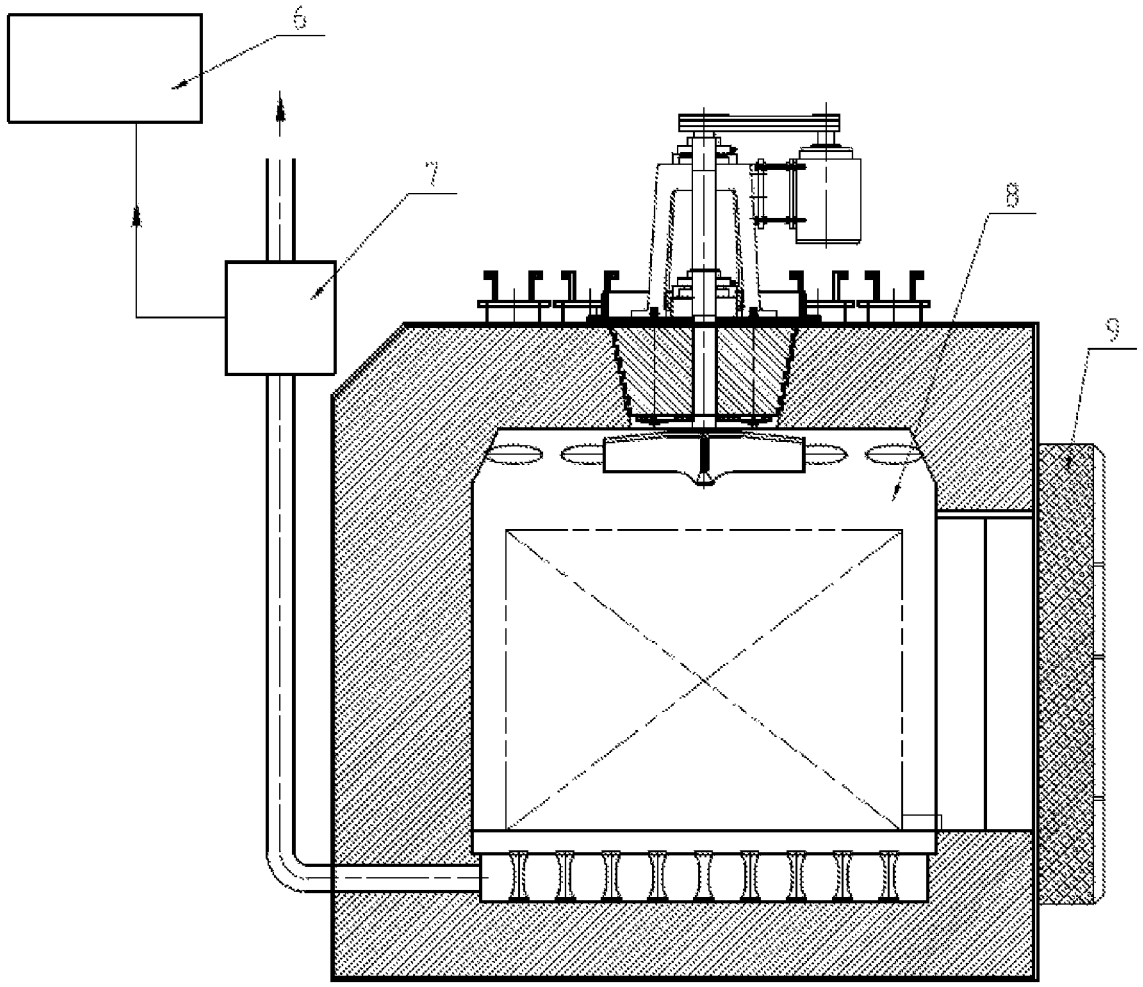
FIG. 2 is a schematic structural cross-sectional left view of an acetylene carburizing furnace according to the Invention.

As shown in FIGS. 1 and 2, an atmospheric-pressure acetylene carburizing furnace comprises a reaction chamber 8, an acetylene intake duct, an exhaust gas duct, a control and metering apparatus 5 arranged on the acetylene intake duct, an exhaust gas measurement apparatus 7 arranged on the exhaust gas duct, and a computer controller 6 respectively connected to the control and metering apparatus 5 and the exhaust gas measurement apparatus 7. A stirring apparatus 1 is arranged at the top of the reaction chamber 8. A heating apparatus 2 is arranged in the reaction chamber 8. A thermal insulation layer 3 is wrapped around an outer layer of the reaction chamber 8. The exhaust gas measurement apparatus 7 comprises a mass spectrometer.

A flow using the carburizing furnace comprises the following steps:

inputting process requirements of a target workpiece into the computer controller 6, opening a furnace door 9, feeding a workpiece 4 into the carburizing furnace, and turning on the heating apparatus 4. After a set temperature is reached in the reaction chamber 8, the computer controller 6 turns on the control and metering apparatus 5 according to a set parameter to introduce acetylene into the reaction chamber 8. After entering the carburizing furnace, the acetylene comes into contact with the metal surface and decomposes in a high-temperature environment. Carbon atoms produced by decomposition are directly kept on the surface of the workpiece, and there are no free carbon atoms. The larger the number of carbon atoms on the surface of the workpiece is, the higher the carburizing speed will be, and the higher the carbon content of the surface of the workpiece will be. During reaction, a dynamic balance is achieved between gas components in the furnace, the control and metering apparatus 5 and the exhaust gas measurement apparatus 7 respectively sends acetylene data and exhaust gas measurement data to the computer controller 6, and the computer controller 6 calculates a total amount of carbon in the furnace and an enrichment rate of a workpiece according to the received data and the law of conservation of mass, and adjusts an acetylene intake volume according to the calculation result. The process continues if a condition is satisfied; otherwise, the control and metering apparatus 5 adjusts the acetylene intake volume until process requirements are met. The control and metering apparatus 5 not only controls entrance of the acetylene into the reaction chamber, but also record the total mass of acetylene entering the reaction chamber. The control and metering apparatus 5 sends the total mass of acetylene entering the reaction chamber to the computer controller 6. After reaction of the acetylene at a high temperature, carbon atoms are left on the metal surface inside the reaction chamber, and an exhaust gas produced by the reaction, including methane, hydrogen, and unreacted acetylene, is discharged from the exhaust gas duct. The exhaust gas measurement apparatus 7 measures a percentage by volume of each gas in the exhaust gas, calculates mass of each gas, and sends the percentage by volume and the mass to the computer controller 6. The computer controller 6 calculates the total amount of carbon in the furnace according to thermal decomposition reaction of acetylene and the law of conservation of mass.

Decomposition of acetylene at a high temperature is expressed as the following equations:

$$2C_2H_2 \xrightleftharpoons{\text{high temperature}} 3[C] + CH_4$$

$$CH_4 \xrightleftharpoons{\text{high temperature}} [C] + 2H_2$$

$$C_2H_2 \xrightleftharpoons{\text{high temperature}} 2[C] + H_2$$

In comparison with other gases, acetylene features a high carbon yield, as shown by the following table:

TABLE 1

Carbon contents and carbon yields of gases
Thermal decomposition during carburizing

| Carburizing gas | Carbon content | Carbon yield |
|---|---|---|
| Methane CH4 | 75% | <3% |
| Dimethylmethane C3H8 | 82% | about 25% |
| Acetylene C2H2 | 92% | about 60% |

where the carbon content is measured in weight percentage, and the carbon yield is the percentage of carbon from gas to the load. As can be seen, the carbon content and carbon yield of acetylene are very high. Therefore, acetylene is the best carburizing atmosphere.

The invention claimed is:

1. An atmospheric-pressure acetylene carburizing furnace, comprises:

a reaction chamber, an acetylene intake duct, an exhaust gas duct, a control and metering apparatus arranged on the acetylene intake duct, an exhaust gas measurement apparatus arranged on the exhaust gas duct, and a computer controller respectively connected to the control and metering apparatus and the exhaust gas measurement apparatus, wherein after a set temperature is reached in the reaction chamber, the computer controller is configured to turn on the control and metering apparatus according to a set parameter to introduce acetylene into the reaction chamber, the control and metering apparatus and the exhaust gas measurement apparatus are configured to send acetylene data and exhaust gas measurement data respectively to the computer controller in real time, and the computer controller is configured to calculate a total amount of carbon in the furnace and an enrichment rate of a workpiece, and adjust an acetylene intake volume according to the calculation result until process requirements are met.

2. The atmospheric-pressure acetylene carburizing furnace according to claim 1, wherein the exhaust gas measurement apparatus comprises a mass spectrometer.

3. The atmospheric-pressure acetylene carburizing furnace according to claim 1, wherein the computer controller is configured to calculate the total amount of carbon in the furnace according to the received data and the law of conservation of mass.

4. The atmospheric-pressure acetylene carburizing furnace according to claim 2, the control and metering apparatus is configured to send a total amount of acetylene entering the reaction chamber to the computer controller; the exhaust gas measurement apparatus is configured to measure a percentage by volume of each gas in an exhaust gas, calculate mass of each gas, and send the percentage by volume and the mass to the computer controller; and the computer controller is configured to calculate the total amount of carbon in the furnace according to thermal decomposition reaction of acetylene and the law of conservation of mass.

5. The atmospheric-pressure acetylene carburizing furnace according to claim 1, wherein an stirring apparatus is arranged at a top of the reaction chamber.

6. The atmospheric-pressure acetylene carburizing furnace according to claim 1, wherein a heating apparatus is arranged in the reaction chamber.

7. The atmospheric-pressure acetylene carburizing furnace according to claim 1, wherein a thermal insulation layer is wrapped around an outer layer of the reaction chamber.

* * * * *